US005297317A

United States Patent [19]

Leifeld et al.

[11] Patent Number: 5,297,317

[45] Date of Patent: Mar. 29, 1994

[54] COILER CAN CONVEYOR WITH POSITIVE GUIDANCE BETWEEN MACHINE ROWS

[75] Inventors: Ferdinand Leifeld, Kempen; Stefan Schlichter, Viersen; Paul G. Teichmann; Manfred Langen, both of Mönchengladbach, all of Fed. Rep. of Germany

[73] Assignee: Trützschler GmbH & Co. KG, Mönchengladbach, Fed. Rep. of Germany

[21] Appl. No.: 699,377

[22] Filed: May 14, 1991

[30] Foreign Application Priority Data

May 14, 1990 [DE] Fed. Rep. of Germany ..... 4015377

[51] Int. Cl.[5] ..... D01H 9/18; B65H 75/16

[52] U.S. Cl. ..... 19/159 A

[58] Field of Search ..... 19/159 A, 157, 65 A; 57/1 R, 266, 268, 270, 276, 281; 414/573, 222, 265, 331, 788; 104/88, 89, 91; 105/148

[56] References Cited

U.S. PATENT DOCUMENTS

| | | | |
|---|---|---|---|
| 3,016,679 | 1/1962 | Rakhorst | 57/36 |
| 3,125,782 | 3/1964 | Kaino et al. | 19/159 A |
| 3,263,281 | 8/1966 | Cole | 19/159 A |
| 3,583,037 | 6/1971 | Krauss et al. | 19/157 X |
| 4,023,339 | 5/1977 | Laderach et al. | 57/286 |
| 4,033,104 | 7/1977 | Kamp | 19/159 A X |
| 4,042,093 | 8/1977 | Fujii et al. | 19/159 A X |
| 4,059,185 | 11/1977 | Weber | 19/159 X |
| 4,150,534 | 4/1979 | Raasch | 19/159 A |
| 4,642,851 | 2/1987 | Hera | 19/159 A |
| 4,694,539 | 9/1987 | Langen | 19/159 A |
| 4,735,040 | 4/1988 | Pircher | 57/266 |
| 4,956,969 | 9/1990 | Raasch | 57/90 X |

FOREIGN PATENT DOCUMENTS

| | | | |
|---|---|---|---|
| 0069087 | 1/1983 | European Pat. Off. | 19/159 A |
| 340459 | 11/1989 | European Pat. Off. . | |
| 371417 | 6/1990 | European Pat. Off. . | |
| 452687 | 10/1991 | European Pat. Off. . | |
| 2410408 | 9/1974 | Fed. Rep. of Germany . | |
| 3621370 | 3/1987 | Fed. Rep. of Germany . | |
| 8700472 | 6/1987 | Fed. Rep. of Germany . | |
| 3809282 | 9/1989 | Fed. Rep. of Germany . | |
| 3831638 | 3/1990 | Fed. Rep. of Germany . | |
| 3831640 | 3/1990 | Fed. Rep. of Germany . | |
| 8812622 | 3/1990 | Fed. Rep. of Germany . | |
| 3905279 | 8/1990 | Fed. Rep. of Germany | 19/159 A |
| 623614 | 6/1981 | Switzerland . | |
| 0213642 | 2/1969 | U.S.S.R. | 19/159 A |
| 972409 | 10/1964 | United Kingdom . | |
| 1228766 | 4/1971 | United Kingdom . | |
| 2171121 | 8/1986 | United Kingdom . | |

*Primary Examiner*—Clifford D. Crowder
*Assistant Examiner*—Ismael Izaguiere
*Attorney, Agent, or Firm*—Spencer, Frank & Schneider

[57] ABSTRACT

An apparatus for transporting a coiler can from a sliver-producing fiber processing machine to a sliver-using fiber processing machine includes a transport carriage provided with wheels; a motor for propelling the transport carriage along a path of travel; and ground-supported rails for positively guiding the transport carriage along its path of travel.

5 Claims, 3 Drawing Sheets

COILER CAN CONVEYOR WITH POSITIVE GUIDANCE BETWEEN MACHINE ROWS

CROSS REFERENCE TO RELATED APPLICATION

This application claims the priority of German Application No. P 40 15 377.0 filed May 14, 1990, which is incorporated herein by reference.

BACKGROUND OF THE INVENTION

1. Field of the Invention

This invention relates to a conveyor apparatus for transporting coiler cans between a sliver-producing fiber processing machine, such as a card and a sliver-using fiber processing machine, such as a drafting frame. The conveyor apparatus has at least one driven transport carriage as well as devices which load and unload the coiler cans.

2. Description of the Related Art

In a known apparatus of the above-outlined type a plurality of transport carriages is hitched together to form a train, drawn by an engine. The carriages are loaded and unloaded by means of a plurality of pusher devices which are mounted stationarily externally of the carriages. It is a disadvantage of such a prior art apparatus that its construction is complex and further, the motion of the train depends on the particular handling of the engine. Further, the requirement for the travel area of the train is substantial.

SUMMARY OF THE INVENTION

It is an object of the invention to provide an improved apparatus of the above-outlined type from which the noted disadvantages are eliminated and which thus is structurally simpler, needs less space and is operationally more reliable than conventional apparatus.

This object and others to become apparent as the specification progresses, are accomplished by the invention, according to which, briefly stated, the apparatus for transporting a coiler can from a sliver-producing fiber processing machine to a sliver-using fiber processing machine includes a transport carriage; a motor for propelling the transport carriage along a path of travel; and a positive guidance arrangement for positively guiding the transport carriage along its path of travel.

By means of the positive guidance of the transport carriage between the fiber processing machines, particularly by using at least one rail or similar component, a structurally simple apparatus for the conveyance of cans is achieved between the fiber processing machines. The apparatus is advantageously of space-saving construction and the conveying carriages are moved in a reliable and precise manner to and between the fiber processing machines.

The invention further has additional advantageous features as follows:

The positive guidance device is a rail which may be arranged overhead or may be secured to the ground in a blower room of the spinning preparation plant. The transport carriage is provided with rollers, wheels and the like which engage the rails. Two parallel rails may be provided which serve as guide rails and which are disposed laterally on either side of the transport carriage, and the wheels are situated underneath the transport carriage. The driving device for the transport carriage is an electromotor which is connected with an electric energy source by appropriate conductors, such as travelling cables or the like. The electromotor is expediently mounted on the transport carriage and the energy supply occurs via the guiding rails. A charging and discharging device is provided on the transport carriage which loads and unloads the transport carriage. Expediently, the transport carriage has a base which is formed of a roller assembly. Between the transport carriage and the rail there is provided an elastic or rotatable coupling. The sliver-producing fiber processing machines, such as carding machines, are arranged in at least one row along the rail for the transport carriage and there is further provided a transversely arranged rail which passes by one end of the first-named rail and along which sliver-using fiber processing machines, such as drafting frames are arranged in at least one row. At least an additional transport carriage is provided which runs on the transverse rail. An additional transport carriage (transverse can changer) is supported by a bridge and is displaceable thereon. The charging and discharging devices for moving the coiler cans onto and from the transport carriage may be one and the same structure or they may be different structures and perform loading and unloading operations simultaneously. The carding machines are arranged in two rows such that coiler can changers of the different rows are in a face-to-face arrangement. Expediently, the transport carriage may be charged and discharged from either side thereof. The driving devices such as an electromotor for the transport carriages, the cards, the coiler can changers at the card and the drafting frames are connected to a common electronic control device.

DESCRIPTION OF THE PREFERRED EMBODIMENTS

Figure 1:
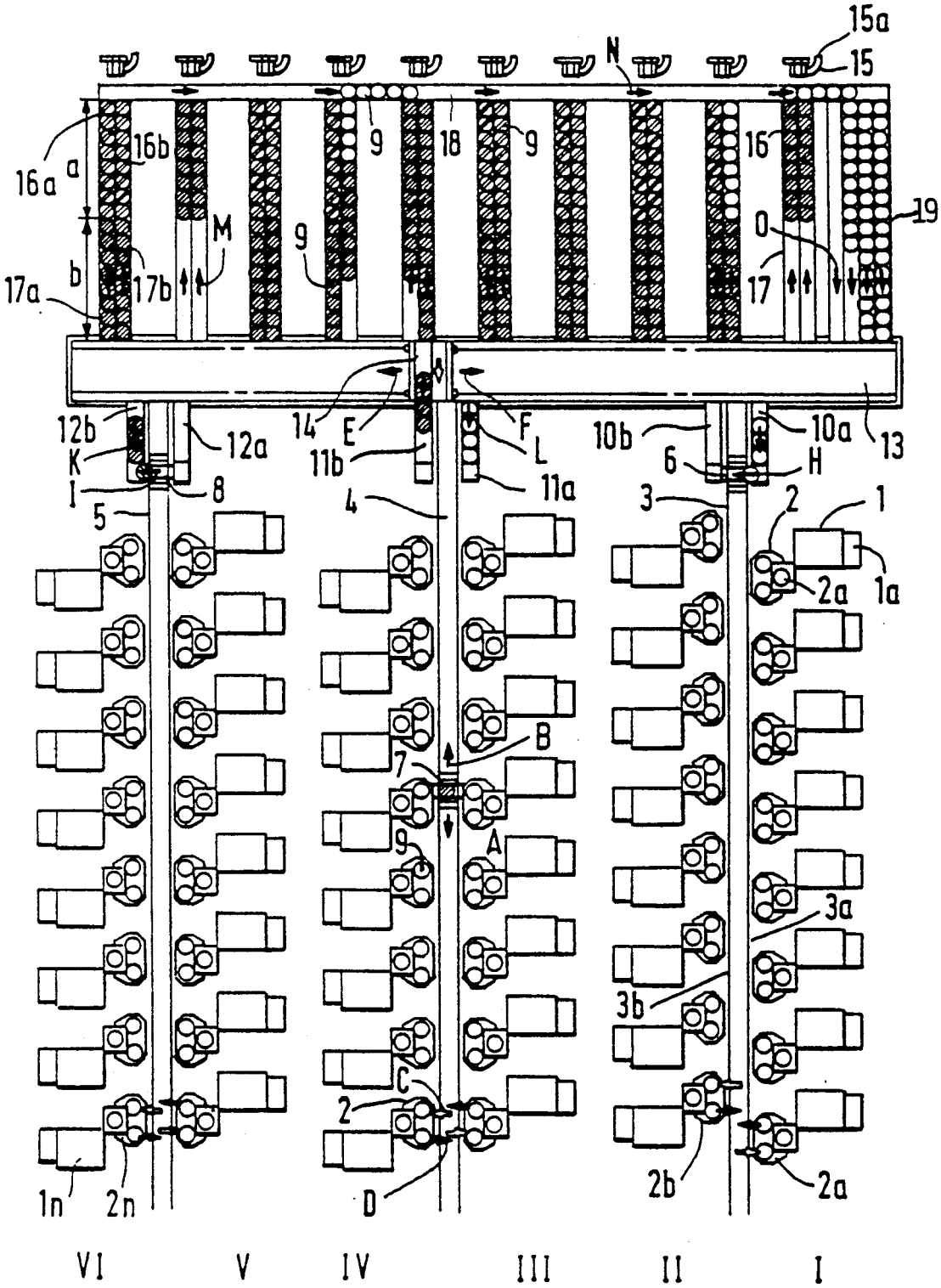
FIG. 1 is a schematic top plan view of a preferred embodiment of the invention.

Turning to FIG. 1, there is schematically illustrated therein a spinning preparation system which includes forty-eight carding machines 1, each producing sliver. The carding machines may be, for example, EXACTACARD DK 740 models, manufactured by Trützschler GmbH & Co. KG, Mönchengladbach, Germany. The system further includes ten drafting frames 15 into which the sliver is introduced after it has been delivered thereto by the coiler can transporting apparatus designed according to the invention.

With each carding machine 1 there is associated a coiler can changer 2, for example, a rotary coiler can changer. The cards 1 are arranged in six rows I-VI and are set up in adjoining rows I, II; III, IV; and V, VI in such a manner that the respective coiler can changers 2 are oriented towards one another. Between the card rows that form a card row pair there is disposed a respective rail track 3, 4 and 5 each composed of two rails 3*a*, 3*b*; 4*a*, 4*b*; and 5*a*, 5*b*. On each rail track 3, 4 and 5 there is arranged a respective transport carriage 6, 7 and 8 for travel in the direction of arrows A and B. The transport carriages support coiler cans 9 which may be moved in the direction of arrow C from the respective carriage towards the can changer 2 and the coiler cans 9 may also be displaced in the direction of the arrow D, from the coiler can changer 2 towards the respective carriage. In FIG. 1 all coiler cans are illustrated with small circles; fully cross-hatched circles designate fully filled cans, half-cross-hatched circles indicate partially filled cans while circles with no cross-hatching indicate empty coiler cans.

A terminal zone of each guide track 3, 4 and 5 projects beyond the respective card rows I-VI; on each side parallel to each terminal zone there is arranged a respective coiler can storing device 10*a*, 10*b*; 11*a*, 11*b*; and 12*a*, 12*b*. The three terminal zones of the guide tracks 3, 4 and 5 end at a guide track 13 which extends perpendicularly to the rail tracks 3, 4 and 5 and on which a carriage 14 may be moved back and forth in the direction of the arrows E and F. A coiler can 9 may be moved in the direction of the arrow H, for example, from the coiler can storing device 10*a* towards the adjoining transport carriage 6 and, in the direction of the arrow I, for example, from the transport carriage 8 towards the adjoining can storing device 12*b*. Further, the can 9 may move in the direction of the arrow K from the can storing device 12*b* towards the carriage 14 and in the direction of the arrow L from the carriage 14 into the can storing device 11*a*.

The drafting frames 15 are arranged in a single column. A drafting frame lane 16 is situated in front of each drafting frame 15 over length a and has a pair of side-by-side arranged can rows 16*a*, 16*b*. Each drafting frame lane 16 is preceded by a buffer lane 17, each having two can rows 17*a*, 17*b* along a length b. The cans 9 are moved in the direction of the arrow M in the buffer lane 17 and the drafting frame lane 16.

End zones of each drafting frame lane 16 terminate at a transversely extending track 18 on which empty cans 9 are moved towards an empty can storing device 19 in the direction of the arrow N which is situated between the tracks 13 and 18. The empty cans 9 are moved in the direction of the arrow O to be received by the carriage 14 moving on track 13.

Figure 2A:
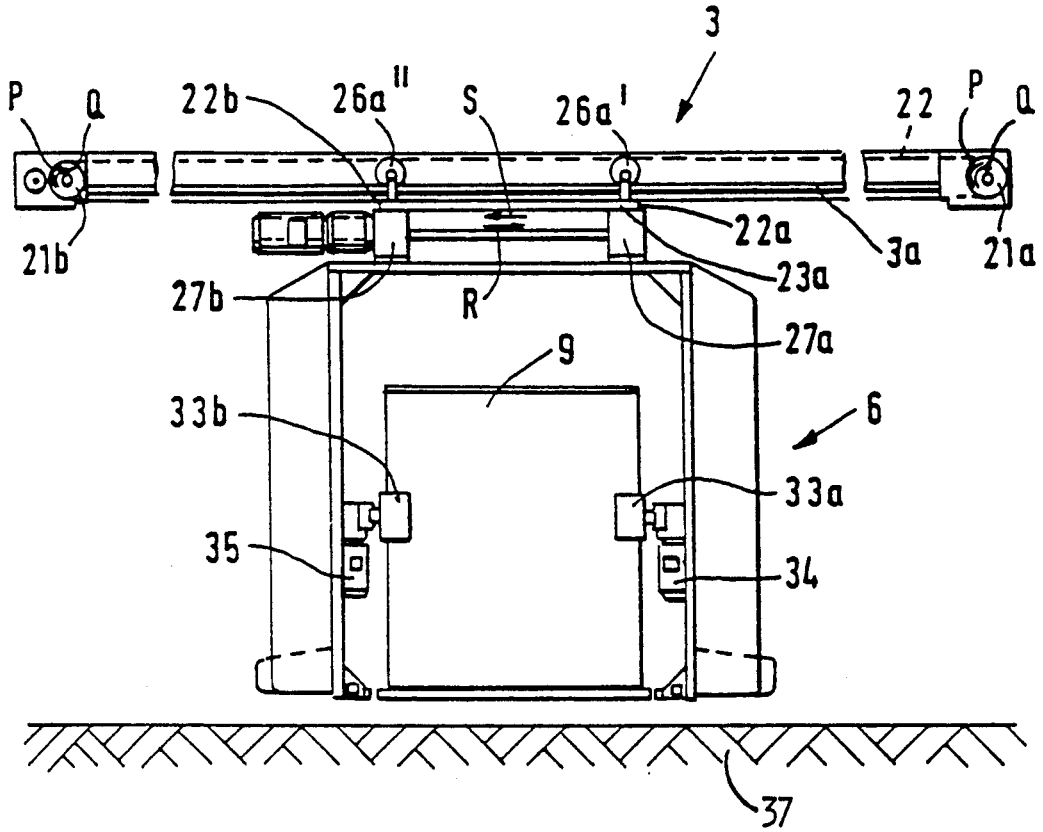
FIG. 2*a* is a schematic side elevational view of some of the components of the construction illustrated in FIG. 1.
Figure 2C:
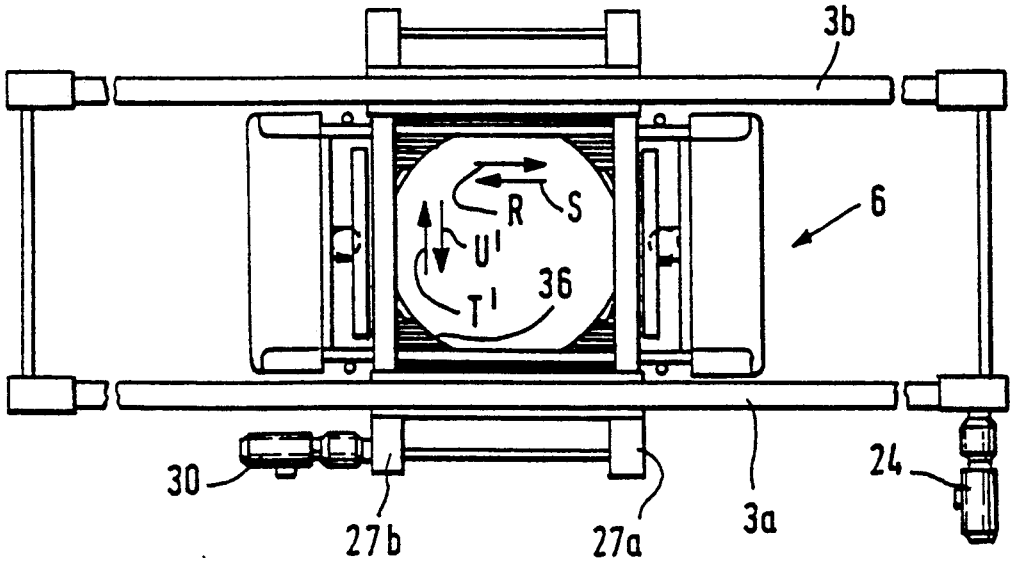
FIG. 2*c* is a top plan view of the components of FIGS. 2*a* and 2*b*.
Figure 2B:
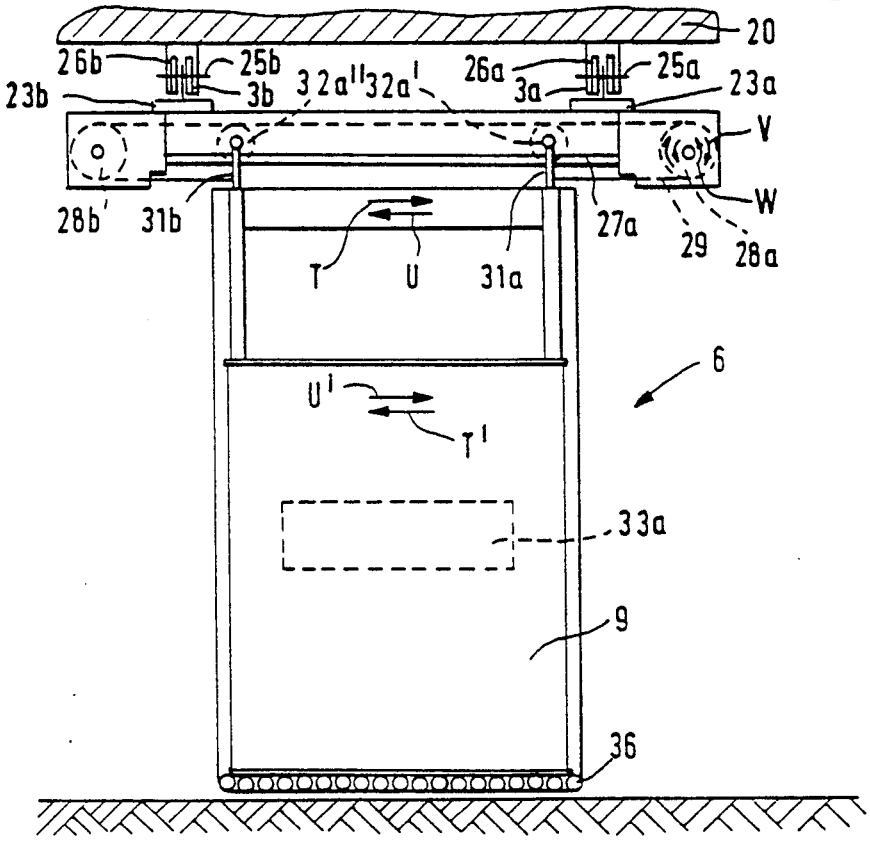
FIG. 2*b* is a front elevational view of some of the components of the construction illustrated in FIG. 1.

FIGS. 2*a*, 2*b* and 2*c* illustrate the rail track 3 and a transport carriage 6 guided thereon. The rails 3*a*, 3*b* of the rail track 3 are stationary and may be affixed to a ceiling 20 as shown in FIG. 2*b*. At the end of the rails 3*a*, 3*b* reversing rollers 21*a*, 21*b* are provided for a chain, cable or similar traction element 22. The reversing roller 21*a* which may rotate in the direction indicated by the arrows P and Q is driven by an electromotor 24. The ends 22*a*, 22*b* of the chain 22 are secured to transverse heads 23*a*, 23*b* of the carriage 6 which is displaceable in the direction indicated by the arrows R, S. The transverse heads 23*a*, 23*b* carry holding elements 24*a*, 24*b* for transverse shafts 25*a*, 25*b* of the wheels 26*a*, 26*b* which engage the rails 3*a* and 3*b*, respectively. Underneath and transversely to the transverse heads 23*a*, 23*b* there are arranged two rails 27*a*, 27*b* which, at their ends, carry reversing rollers 28*a*, 28*b* for a drive chain 29. The reversing roller 28*a* is rotatable in the direction indicated by the arrows V and W and is driven by an electromotor 30. In this manner, the transport carriage 6 is movable in the direction of the arrows T and U transversely to the longitudinal travelling direction R, S. The rails 27*a*, 27*b* engage the rollers 32*a*, 32*b* which are mounted to the carriage 6 by holding elements 31*a*, 31*b*. In this manner, the carriage 6 may be moved in the direction of the coiler can changer 2*a* or 2*b* of the side-by-side oriented card rows I and II, respectively.

Two grippers 33*a*, 33*b* are provided for the can 9; the grippers may each be driven by a respective electromotor 34 and 35. The grippers 33*a*, 33*b* move the can 9 in the direction of the arrows T', U'. The bottom of the carriage 6 is formed as a roller track 36 wherein the roller axes are oriented in the direction of the arrows R, S. Between the underside of the carriage 6 and the blow room floor 37 a clearance is provided to ensure that the carriage 6 is in suspension.

Figure 3:
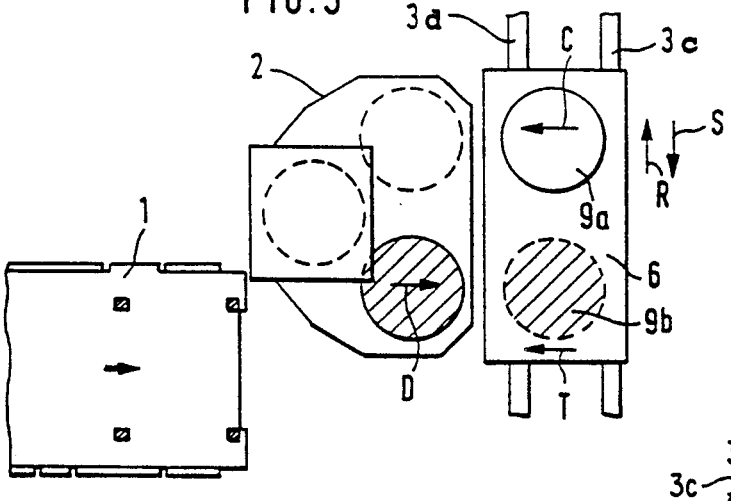
FIG. 3 is a schematic top plan view of further components of the preferred embodiment.
Figure 3A:
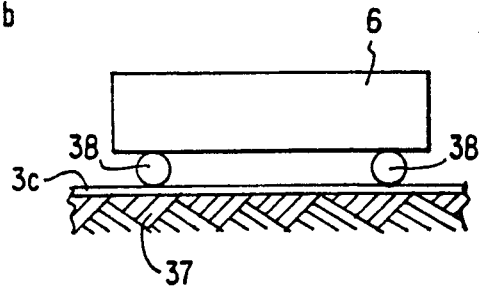
FIG. 3*a* is a schematic side elevational view of some of the components of FIG. 3.

Turning to FIGS. 3 and 3*a*, there is illustrated therein a coiler changer 2 at which the transport carriage 6 has stopped with two cans 9*a*, 9*b*. By virtue of a non-illustrated rotary arm of the rotary can changer 2 (which is of conventional construction) the empty can 9*a* is moved in the direction of arrow C into the can changer 2 while the can 9*b* which is filled with sliver is moved out of the can changer 2 in the direction of the arrow D. The carriage 6 is moved in the direction of the arrow T to be closely juxtapositioned to the can changer 2. Below the carriage 6 parallel rails 3*c* and 3*d* extend which are supported on the floor (ground) 37 and which are engaged by wheels 38 rotatably mounted on a lower part of the carriage 6.

It will be understood that the above description of the present invention is susceptible to various modifications, changes and adaptations, and the same are intended to be comprehended within the meaning and range of equivalents of the appended claims.

What is claimed is:

1. An apparatus for transporting a coiler can from a sliver-producing fiber processing machine to a sliver-using fiber processing machine in combination with a plurality of sliver-producing fiber processing machines and a plurality of sliver-using drafting frames; each drafting frame having a drafting frame lane for receiving coiler cans; said apparatus comprising (a) a transport carriage;

(b) motor means for propelling the transport carriage along a path of travel;

(c) positive guidance means for positively guiding the transport carriage along said path of travel; wherein said positive guidance means comprises (1) spaced first rail tracks each having an end and each supporting a separate said transport carriage; said sliver-producing fiber processing machines being arranged in rows along said first rail tracks;

(2) a second rail track extending transversely to the first rail tracks and operatively connecting the ends of said first rail tracks; said drafting frames being arranged along said second rail track; and (d) a separate can storing device situated at each said drafting frame lane; the can storing devices being arranged along said second rail track.

2. An apparatus as defined in claim 1, further wherein each drafting frame lane has an end adjoining a respective said drafting frame; further comprising a track operatively connecting the ends of said drafting frame lanes; and a transport carriage located on said track for carrying empty coiler cans away from said drafting frames.

3. A system for transporting coiler cans, comprising (a) a plurality of sliver-handling fiber processing machines arranged to form first and second machine rows; the first and the second rows extending parallel to one another and the machines of the first row facing the second row and the machines of the second row facing the first row;

(b) a track formed of ground-supported rails extending between said first and second machine rows parallel thereto;

(c) a transport carriage including (1) wheels rotatably mounted at a lower part of said transport carriage; said wheels being in engagement with said rails;

(2) motor means for propelling the transport carriage on said track; and (3) can moving means mounted on said carriage for moving a coiler can to and from a respective sliver-handling fiber processing machine from and onto the carriage at either side of said carriage transversely to said track; and (d) a coiler can changer associated with each sliver-handling fiber processing machine; said can moving means moving coiler cans into and from the coiler can changers; each said coiler can changer of the machines of the first and second machine rows facing said track, whereby a coiler can is movable into and from any selected coiler can changer on either side of the transporting carriage by said can moving means from and to said transporting carriage.

4. The system of claim 3, wherein said sliver-handling fiber processing machines are carding machines.

5. The system of claim 3, wherein said can moving means comprises a can charging device and a can discharging device for simultaneously loading and unloading said transport carriage.

* * * * *